US009005050B2

(12) United States Patent
Okabe

(10) Patent No.: US 9,005,050 B2
(45) Date of Patent: Apr. 14, 2015

(54) GOLF BALL

(75) Inventor: Satoko Okabe, Kobe (JP)

(73) Assignee: SRI Sports Limited, Kobe-shi (JP)

( * ) Notice: Subject to any disclaimer, the term of this patent is extended or adjusted under 35 U.S.C. 154(b) by 629 days.

(21) Appl. No.: 13/046,867

(22) Filed: Mar. 14, 2011

(65) Prior Publication Data

US 2011/0237348 A1 Sep. 29, 2011

(30) Foreign Application Priority Data

Mar. 26, 2010 (JP) ..... 2010-073290

(51) Int. Cl.
*A63B 37/04* (2006.01)
*A63B 37/00* (2006.01)
*A63B 37/06* (2006.01)

(52) U.S. Cl.
CPC ..... *A63B 37/0003* (2013.01); *A63B 37/0031* (2013.01); *A63B 37/0033* (2013.01); *A63B 37/0039* (2013.01); *A63B 37/004* (2013.01); *A63B 37/0043* (2013.01); *A63B 37/0045* (2013.01); *A63B 37/0049* (2013.01); *A63B 37/0062* (2013.01); *A63B 37/0064* (2013.01); *A63B 37/0087* (2013.01); *A63B 37/06* (2013.01)

(58) Field of Classification Search
None
See application file for complete search history.

(56) References Cited

U.S. PATENT DOCUMENTS

| | | | | |
|---|---|---|---|---|
| 5,047,478 | A | 9/1991 | Ohmae et al. | |
| 5,091,478 | A * | 2/1992 | Saltman | 525/179 |
| 5,176,952 | A | 1/1993 | Joseph et al. | |
| 5,210,138 | A * | 5/1993 | Yamamoto et al. | 525/183 |
| 5,288,242 | A | 2/1994 | Muzslay | |
| 5,587,236 | A | 12/1996 | Agrawal et al. | |
| 5,605,968 | A | 2/1997 | Egashira et al. | |
| 5,656,695 | A | 8/1997 | Endo et al. | |
| 5,713,802 | A | 2/1998 | Moriyama et al. | |
| 5,789,021 | A | 8/1998 | Dooms et al. | |
| 5,820,486 | A | 10/1998 | Tanaka et al. | |
| 5,886,103 | A | 3/1999 | Bellinger et al. | |
| 5,889,114 | A | 3/1999 | Statz | |
| 5,919,862 | A | 7/1999 | Rajagopalan | |
| 5,976,034 | A | 11/1999 | Kato et al. | |
| 6,045,460 | A | 4/2000 | Hayashi et al. | |
| 6,187,864 | B1 | 2/2001 | Rajagopalan | |
| 6,274,669 | B1 * | 8/2001 | Rajagopalan | 525/64 |
| 6,284,840 | B1 | 9/2001 | Rajagopalan et al. | |
| 6,353,058 | B1 * | 3/2002 | Rajagopalan | 525/179 |
| 6,468,169 | B1 | 10/2002 | Hayashi et al. | |
| 6,486,250 | B1 | 11/2002 | Rajagopalan | |
| 6,702,694 | B1 | 3/2004 | Watanabe | |
| 6,762,244 | B2 * | 7/2004 | Rajagopalan et al. | 525/74 |
| 6,774,184 | B2 * | 8/2004 | Rajagopalan | 525/183 |
| 6,800,690 | B2 * | 10/2004 | Rajagopalan et al. | 525/183 |
| 6,966,849 | B2 | 11/2005 | Kato | |
| 7,393,288 | B2 | 7/2008 | Egashira et al. | |
| 7,393,289 | B2 | 7/2008 | Egashira et al. | |
| 8,372,915 | B2 * | 2/2013 | Ohama et al. | 525/133 |
| 8,501,871 | B2 * | 8/2013 | Okabe et al. | 525/179 |
| 2002/0013413 | A1 * | 1/2002 | Bellinger et al. | 525/179 |
| 2002/0098915 | A1 | 7/2002 | Cavallaro et al. | |
| 2002/0147280 | A1 * | 10/2002 | Rajagopalan | 525/179 |
| 2003/0104879 | A1 | 6/2003 | Iwami | |
| 2004/0029648 | A1 | 2/2004 | Kato | |
| 2004/0053706 | A1 | 3/2004 | Kennedy, III et al. | |
| 2004/0116211 | A1 * | 6/2004 | Sullivan et al. | 473/374 |
| 2004/0121856 | A1 | 6/2004 | Iwami | |
| 2004/0142770 | A1 | 7/2004 | Watanabe | |
| 2004/0209708 | A1 | 10/2004 | Bulpett et al. | |
| 2004/0235587 | A1 | 11/2004 | Sullivan et al. | |
| 2006/0063893 | A1 | 3/2006 | Rajagopalan | |
| 2006/0116220 | A1 * | 6/2006 | Ohama et al. | 473/371 |
| 2006/0270492 | A1 | 11/2006 | Higuchi et al. | |
| 2006/0293121 | A1 | 12/2006 | Egashira et al. | |
| 2007/0049419 | A1 | 3/2007 | Egashira et al. | |
| 2007/0111823 | A1 | 5/2007 | Higuchi et al. | |
| 2007/0142128 | A1 | 6/2007 | Watanabe | |
| 2007/0281802 | A1 | 12/2007 | Watanabe et al. | |
| 2007/0281804 | A1 * | 12/2007 | Kamino et al. | 473/376 |
| 2008/0076604 | A1 | 3/2008 | Watanabe | |

(Continued)

FOREIGN PATENT DOCUMENTS

| | | | |
|---|---|---|---|
| JP | S60-60867 | A | 4/1985 |
| JP | 62-22841 | A | 1/1987 |

(Continued)

OTHER PUBLICATIONS

English translation of the Japanese Office Action for Japanese Application No. 2008-335261 dated Feb. 27, 2013.

(Continued)

*Primary Examiner* — Alvin Hunter
*Assistant Examiner* — John E Simms, Jr.
(74) *Attorney, Agent, or Firm* — Birch, Stewart, Kolasch & Birch, LLP

(57) ABSTRACT

An object of the present invention is to provide a golf ball that decrease the spin rate on the driver shots while suppressing the decrease in the spin rate on the approach shots in a golf ball having a urethane cover. The present invention provides a golf ball having a core consisting of a center and at least one intermediate layer covering the center, and a cover covering the core, wherein the cover contains polyurethane, and has a slab hardness of 85 or less in JIS A hardness, the core has a surface hardness of 60 or more in Shore D hardness, the intermediate layer has a thickness ranging from 0.5 mm to 2.0 mm, and a resin component constituting the intermediate layer has a hardness from 62 to 68 in Shore D hardness, a flexural modulus from 300 MPa to 500 MPa, and a maximum storage modulus E' between −30° C. to 0° C. ranging from 1,000 MPa to 2,000 MPa.

17 Claims, No Drawings

(56) References Cited

U.S. PATENT DOCUMENTS

| | | | | |
|---|---|---|---|---|
| 2008/0161131 | A1 | 7/2008 | Ladd et al. | |
| 2008/0161133 | A1 | 7/2008 | Sullivan et al. | |
| 2008/0220900 | A1 | 9/2008 | Komatsu | |
| 2008/0227569 | A1 | 9/2008 | Egashira et al. | |
| 2008/0242447 | A1 | 10/2008 | Egashira et al. | |
| 2008/0254914 | A1 | 10/2008 | Manami et al. | |
| 2009/0270203 | A1* | 10/2009 | Okabe | 473/374 |
| 2009/0280927 | A1 | 11/2009 | Sullivan et al. | |
| 2010/0009776 | A1* | 1/2010 | Okabe et al. | 473/373 |
| 2010/0009779 | A1 | 1/2010 | Egashira et al. | |
| 2010/0093466 | A1 | 4/2010 | Ohama et al. | |
| 2010/0167841 | A1 | 7/2010 | Okabe et al. | |
| 2010/0167842 | A1 | 7/2010 | Okabe | |
| 2011/0237348 | A1 | 9/2011 | Okabe | |
| 2012/0010347 | A1 | 1/2012 | Egashira et al. | |

FOREIGN PATENT DOCUMENTS

| | | | | |
|---|---|---|---|---|
| JP | 63-146928 | A | 6/1988 | |
| JP | 2-51544 | A | 2/1990 | |
| JP | 3-64343 | A | 3/1991 | |
| JP | 6-145486 | A | 5/1994 | |
| JP | 9-38238 | A | 2/1997 | |
| JP | 9-248351 | A | 9/1997 | |
| JP | 10-179802 | A | 7/1998 | |
| JP | 10-314341 | A | 12/1998 | |
| JP | 10-328326 | A | 12/1998 | |
| JP | 2001-509204 | A | 7/2001 | |
| JP | 2001-514561 | A | 9/2001 | |
| JP | 2003-48286 | A | 2/2003 | |
| JP | 2003-504089 | A | 2/2003 | |
| JP | 2003-111870 | A | 4/2003 | |
| JP | 2003-159351 | A | 6/2003 | |
| JP | 2004-59656 | A | 2/2004 | |
| JP | 2004-75776 | A | 3/2004 | |
| JP | 2004-97802 | A | 4/2004 | |
| JP | 2004-130072 | A | 4/2004 | |
| JP | 2004-187991 | A | 7/2004 | |
| JP | 2004-188207 | A | 7/2004 | |
| JP | 2004-305754 | A | 11/2004 | |
| JP | 2005-112990 | A | 4/2005 | |
| JP | 2006-326301 | A | 12/2006 | |
| JP | 2007-622 | A | 1/2007 | |
| JP | 2007-61605 | A | 3/2007 | |
| JP | 2007-319589 | A | 12/2007 | |
| JP | 2008-69463 | A | 3/2008 | |
| JP | 2009-261791 | A | 11/2009 | |
| JP | 2009-261792 | A | 11/2009 | |
| JP | 2008 0181892 | * | 1/2010 | A63B 37/00 |
| JP | 2010-17414 | A | 1/2010 | |
| WO | WO 99/08756 | A1 | 2/1999 | |

OTHER PUBLICATIONS

English translation of the Japanese Office Action for Japanese Application No. 2008-335262 dated Feb. 27, 2013.
English translation of the Japanese Office Action for Japanese Application No. 2008-335265 dated Feb. 26, 2013.
DuPont, DuPont™ Surlyn® 8940, DuPont Packaging & Industrial Polymers, pp. 1-3, Jan. 7, 2010.
English translation of an Office Action for Japanese Application No. 2009-140164, dated Jul. 10, 2012.
English translation of Office Action for Japanese Application No. 2008-117574, dated Feb. 21, 2012.
English translation of Office Action for Japanese Application No. 2008-117574, dated May 15, 2012.
English translation of Office Action for Japanese Application No. 2008-264249, dated Dec. 27, 2011.
English translation of Office Action for Japanese Application No. 2008-264249, dated Mar. 22, 2011.
English translation of Office Action for Japanese Application No. 2008-335261, dated Apr. 19, 2011.
English translation of Office Action for Japanese Application No. 2008-335261, dated Jan. 17, 2012.
English translation of Office Action for Japanese Application No. 2008-335261, dated Jun. 12, 2012.
English translation of Office Action for Japanese Application No. 2008-335262, dated Apr. 19, 2011.
English translation of Office Action for Japanese Application No. 2008-335262, dated Jan. 17, 2012.
English translation of Office Action for Japanese Application No. 2008-335262, dated Jun. 12, 2012.
English translation of Office Action for Japanese Application No. 2008-335265, dated Apr. 19, 2011.
English translation of Office Action for Japanese Application No. 2008-335265, dated Jan. 17, 2012.
Office Action for U.S. Appl. No. 12/425,746, dated Oct. 20, 2011.
Office Action for U.S. Appl. No. 12/498,138, dated Apr. 11, 2012.
Office Action for U.S. Appl. No. 12/498,138, dated Nov. 3, 2011.
Office Action for U.S. Appl. No. 12/574,462, dated Jun. 13, 2012.
Office Action for U.S. Appl. No. 12/647,122, dated May 21, 2012.
Office Action for U.S. Appl. No. 12/647,127, dated Jun. 13, 2012.
Thain, "Compression by Any Other Name," Science and Golf IV, Proceedings of the World Scientific Congress of Golf, World Scientific Congress of Golf, St. Andrews, Scotland, Jul. 22-26, 2002, pp. 319-327.
Office Action for corresponding U.S. Appl. No. 12/647,122 dated Oct. 12, 2012.
English translation of an Office Action for Japanese Application No. 2010-073290, dated Apr. 2, 2013.
English translation of a Questioning for Japanese Application No. 2008-335265 dated Jul. 30, 2012.
Englsih translation of a Japanese Office Action for Japanese Application No. 2008-181892 dated Aug. 28, 2012.
English translation of a Japanese Office Action for Japanese Application No. 2008-335265, dated Dec. 11, 2012.
English translation of a Japanese Questioning for Japanese Application No. 2008-335261, dated Dec. 11, 2012.
English translation of Japanese Questioning forJapanese Application No. 2008-335262, dated Dec. 11, 2012.
efunda.com, "Properties of Polyamide {nylon (PA 12), molding and extrusion compound}", eFunda Polymers, http://www.efunda.com/materials/polymers/properties/polymer_datasheet.cfm?MajorID=PA&MinorID=81 (retrieved from the Internet Aug. 7, 2013), pp. 1-2.
United States Office Action for U.S. Appl. No. 12/647,122 dated Aug. 13, 2013.
United States Office Action for U.S. Appl. No. 12/647,122 dated Feb. 20, 2014.
U.S. Office Action, dated Aug. 18, 2014, for U.S. Appl. No. 12/647,122.

* cited by examiner

GOLF BALL

FIELD OF THE INVENTION

The present invention relates to a golf ball having a urethane cover.

DESCRIPTION OF THE RELATED ART

In three-piece golf balls and multi-piece golf balls, golf balls having improved flight distance are proposed. In these golf balls, the intermediate layer having a high rigidity or high modulus is employed to increase the launch angle and reduce the spin rate.

For example, Japanese Patent Publication No. 2010-17414 A discloses a golf ball comprising: a core consisting of a center and one or more intermediate layers covering the center; and a cover covering the core, wherein at least one piece or one layer of said intermediate layers is formed from a highly elastic intermediate layer composition that contains (A) a highly elastic polyamide resin having a flexural modulus in a range from 700 MPa to 5,000 MPa; (B) a metal-neutralized product of ethylene-(meth)acrylic acid copolymer in a content ratio ((A)/(B)) of (A) the highly elastic polyamide resin to (B) the metal-neutralized product of ethylene-(meth)acrylic acid copolymer being (20 mass % to 80 mass %)/(80 mass % to 20 mass %) (the total is 100 mass %); and (C) a resin having a polar functional group in an amount of 0.1 part by mass to 20 parts by mass with respect to 100 parts by mass of the sum of (A) the highly elastic polyamide resin and (B) the metal-neutralized product of ethylene-(meth)acrylic acid copolymer.

Japanese Patent Publication No. 2009-261791 A discloses a golf ball comprising: a core consisting of a center and one or more intermediate layers covering the center; and a cover covering the core, wherein at least one piece or one layer of said intermediate layers is formed from a highly elastic intermediate layer composition that contains (A) a highly elastic resin having a flexural modulus in a range from 700 MPa to 5,000 MPa and (B) an ionomer resin having a flexural modulus in a range from 150 MPa to 1,000 MPa in a content ratio ((A)/(B)) of (A) the highly elastic resin to (B) the ionomer resin being (20 mass % to 80 mass %)/(80 mass % to 20 mass %) (the total is 100 mass %).

Japanese Patent Publication No. 2009-261792 A discloses a golf ball comprising: a core consisting of a center and one or more intermediate layers covering the center; and a cover covering the core, wherein at least one piece or one layer of said intermediate layers is formed from a highly rigid intermediate layer composition that contains, as a resin component, (a) ethylene-(meth)acrylic acid copolymer or a metal-neutralized product thereof, (b) a copolymer of α-olefin and glycidyl (meth)acrylate or glycidyl unsaturated ether, (c) polyolefin, and (d) an ionomer resin neutralized with another metal than that of the metal-neutralized product of (a) ethylene-(meth)acrylic acid copolymer, in a mass ratio ((a+b+c)/d) of a total mass (a+b+c) of (a) ethylene-(meth)acrylic acid copolymer or a metal-neutralized product thereof, (b) a copolymer of α-olefin and glycidyl (meth)acrylate or glycidyl unsaturated ether, and (c) polyolefin to a mass of (d) the ionomer resin neutralized with another metal than that of the metal-neutralized product of (a) ethylene-(meth)acrylic acid copolymer in the resin component being from 95 mass parts/5 mass parts to 50 mass parts/50 mass parts.

SUMMARY OF THE INVENTION

It is an ultimate goal for those who develop golf balls to provide a golf ball traveling a great distance on driver shots, and stopping quickly on the green on approach shots. The golf ball should have a lower spin rate on the driver shots in order to travel a great distance and should have a higher spin rate on the approach shots in order to stop quickly on the green. In general, the spin rate on the approach shots and the spin rate on the driver shots meet the linear relationship in the case that the golf balls have the same structure and the same compression deformation amount. That is, if the spin rate on the approach shots increases, the spin rate on the driver shots increase. If the spin rate on the approach shots decreases, the spin rate on the driver shots decreases. Therefore, an attempt to increase a flight distance by reducing the spin rate on the driver shots leads to a problem of reducing the spin rate on the approach shots.

The present invention has been achieved in view of the above circumstances. An object of the present invention is to provide a novel golf ball traveling a great distance while maintaining the controllability by decreasing the spin rate on the driver shots while suppressing the decrease in the spin rate on the approach shots.

The inventor of the present invention has achieved the present invention on the findings that employing a specific intermediate layer reduces the spin rate on the driver shots while suppressing the decrease in the spin rate on the approach shots in a multi-piece golf ball (including a three-piece golf ball) having a urethane cover. The present invention that has solved the above problems provides a golf ball having a core consisting of a center and at least one intermediate layer covering the center, and a cover covering the core, wherein the cover contains polyurethane, and has a slab hardness of 85 or less in JIS A hardness, the core has a surface hardness of 60 or more in Shore D hardness, the intermediate layer has a thickness ranging from 0.5 mm to 2.0 mm, and a resin component constituting the intermediate layer has a hardness from 62 to 68 in Shore D hardness, a flexural modulus from 300 MPa to 500 MPa, and a maximum storage modulus E' between −30° C. to 0° C. ranging from 1,000 MPa to 2,000 MPa. Since the present invention is configured as described above, the golf ball of the present invention can decrease the spin rate on the driver shot while suppressing the decrease in the spin rates on the approach shots. As a result, the golf ball of the present invention travels a great distance while maintaining the controllability. In the present invention, the reason for focusing on a maximum storage modulus E' between −30° C. to 0° C. is as follows. The contact time between the golf ball and the golf club when hitting the golf ball is several hundreds micro seconds. If this impact is considered as one deformation, this deformation corresponds to the deformation at the frequency of several thousands Hertz. Based on the time-temperature superposition principle of the general polyurethane elastomer, it is considered that the behavior of the viscoelasticity (storage modulus E') measured at the conditions of temperature: room temperature and oscillation frequency: several thousands Hertz has a relation to the behavior of the viscoelasticity (storage modulus E') measured at the conditions of temperature: −30° C. to 0° C. and oscillation frequency: 10 Hz.

According to the present invention, a golf ball traveling a great distance while maintaining the controllability by decreasing the spin rate on the driver shots while suppressing the decrease in the spin rate on the approach shots is obtained.

DESCRIPTION OF THE PREFERRED EMBODIMENT

The present invention provides a golf ball having a core consisting of a center and at least one intermediate layer covering the center, and a cover covering the core, wherein the cover contains polyurethane, and has a slab hardness of 85 or less in JIS A hardness, the core has a surface hardness of 60 or more in Shore D hardness, the intermediate layer has a thickness ranging from 0.5 mm to 2.0 mm, and a resin component constituting the intermediate layer has a hardness from 62 to 68 in Shore D hardness, a flexural modulus from 300 MPa to 500 MPa, and a maximum storage modulus E' between −30° C. to 0° C. ranging from 1,000 MPa to 2,000 MPa.

First, the intermediate layer of the golf ball of the present invention will be explained.

The thickness of the intermediate layer of the golf ball of the present invention is preferably 0.5 mm or more, more preferably 0.6 mm or more, and even more preferably 0.7 mm or more, and is preferably 2.0 mm or less, more preferably 1.8 mm or less, and even more preferably 1.5 mm or less. If the thickness of the intermediate layer is 0.5 mm or more, since the intermediate layer does not become excessively thin, the durability of the golf ball becomes better. If the thickness of the intermediate layer is 2.0 mm or less, the resilience of the golf ball becomes better to give a greater flight distance. Further, the shot feeling becomes better.

The resin component constituting the intermediate layer preferably has a slab hardness of 62 or more, more preferably 63 or more, even more preferably 64 or more, and preferably has a slab hardness of 68 or less, more preferably 67 or less, even more preferably 66 or less in Shore D hardness. If the slab hardness of the resin component constituting the intermediate layer falls within the above range, the shot feeling does not become hard and the effect of the high launch angle and low spin rate becomes larger. The hardness of the resin component constituting the intermediate layer is a slab hardness obtained by measuring the hardness of the resin component molded into a sheet form.

The resin component constituting the intermediate layer preferably has a flexural modulus of 300 MPa or more, more preferably 310 MPa or more, even more preferably 320 MPa or more, and preferably has a flexural modulus of 500 MPa or less, more preferably 490 MPa or less, even more preferably 480 MPa or less. If the flexural modulus is 300 MPa or more, the effect of the high launch angle and low spin rate becomes larger. If the flexural modulus is 500 MPa or less, the intermediate layer does not become excessively hard, the lowering of the moldability is suppressed. Further, the durability of the golf ball becomes better.

The resin component constituting the intermediate layer preferably has a maximum storage modulus E' of 1,000 MPa or more between −30° C. to 0° C., more preferably 1,100 MPa or more, even more preferably 1,200 MPa or more, and preferably has a maximum storage modulus E' of 2,000 MPa or less, more preferably 1,900 MPa or less, even more preferably 1,800 MPa or less. If the maximum storage modulus E' is 1,000 MPa or more, the effect of the high launch angle and low spin rate becomes larger. If the maximum storage modulus E' is 2,000 MPa or less, the shot feeling does not become hard, and it is possible to provide a desired low spin rate.

The melt flow rate (240° C., 2.16 kg) of the resin component constituting the intermediate layer is preferably 1.0 g/10 min or more, more preferably 1.5 g/10 min or more, and even more preferably 2.0 g/10 min or more, and is preferably 30.0 g/10 min or less, more preferably 28.0 g/10 min or less, and even more preferably 26.0 g/10 min or less. If the melt flow rate is 1.0 g/10 min or more, the fluidity of the intermediate layer composition becomes good, and it is possible to make a thin-walled intermediate layer. Thus, the spin rate when hitting a driver shot is reduced to give a great flight distance. If the melt flow rate is 30.0 g/10 min or less, the intermediate layer does not become excessively hard. Thus, the flight distance is improved while suppressing the lowering of the durability.

The flexural modulus, slab hardness, storage modulus, melt flow rate are measured by a method described later. The flexural modulus, slab hardness, storage modulus, melt flow rate of the resin component constituting the intermediate layer can be adjusted by appropriately selecting kinds, combinations and contents of (A) the polyamide resin composition and (B) the copolymer and/or a metal salt thereof.

The intermediate layer is preferably formed from a high fluidity intermediate layer composition that contains as a resin component (A) a polyamide resin composition having a flexural modulus in a range from 500 MPa to 4,000 MPa and a melt flow rate (240° C., 2.16 kg) of 5.0 g/10 min or more, and containing (a-1) a polyamide resin and (a-2) a resin having at least one functional group selected from the group consisting of a hydroxyl group, a carboxyl group, an anhydride group, a sulfonic acid group, and an epoxy group (including a glycidyl group); and (B) at least one member selected from the group consisting of an ethylene-(meth) acrylic acid binary copolymer, a metal-neutralized product of the ethylene-(meth)acrylic acid binary copolymer, an ethylene-(meth)acrylic acid-(meth)acrylic acid ester ternary copolymer, and a metal-neutralized product of the ethylene-(meth)acrylic acid-(meth)acrylic acid ester ternary copolymer.

Since the high fluidity intermediate layer composition of the present invention contains (A) component and (B) component, the resilience and the fluidity of the intermediate layer composition are improved. If the intermediate layer is formed from the above intermediate layer composition, the intermediate layer having a high resilience is obtained. As a result, the core is designed to have a high repulsion and a hardness distribution of an outer-hard and inner-soft structure, resulting in a high launch angle and low spin rate when struck with a driver or the like, which gives a great flight distance.

(A) The polyamide resin composition having a flexural modulus in a range from 500 MPa to 4,000 MPa and a melt flow rate (240° C., 2.16 kg) of 5.0 g/10 min or more (hereinafter, sometimes merely referred to as "(A) polyamide resin composition") will be explained.

The melt flow rate (240° C., 2.16 kg) of (A) the polyamide resin composition is preferably 5.0 g/10 min or more, more preferably 6.0 g/10 min or more, and even more preferably 7.0 g/10 min or more, and is preferably 150 g/10 min or less, more preferably 120 g/10 min or less, and even more preferably 110 g/10 min or less. If the melt flow rate of (A) the polyamide resin composition is 5.0 g/10 min or more, since the fluidity of the intermediate layer composition becomes good, it is possible to make a thin-walled intermediate layer. Thus, the spin rate can be reduced upon a shot with a driver or the like, thereby obtaining a great flight distance. If the melt flow rate of (A) the polyamide resin composition is 150 MPa or less, the durability of the resultant golf ball improves.

The flexural modulus of (A) the polyamide resin composition is preferably 500 MPa or more, more preferably 520 MPa or more, and even more preferably 550 MPa or more, and is preferably 4,000 MPa or less, more preferably 3,500 MPa or less, and even more preferably 3,000 MPa or less. If the flexural modulus of (A) the polyamide resin composition is 500 MPa or more, the intermediate layer has a sufficient resilience, and hence the effect of reducing the spin rate when hitting the driver shot is obtained. If the flexural modulus of (A) the polyamide resin composition is 4,000 MPa or less, the intermediate layer is not excessively hard, and thus the shot feeling and durability becomes good.

(A) The polyamide resin composition preferably contains (a-1) a polyamide resin and (a-2) a resin having at least one functional group selected from the group consisting of a hydroxyl group, a carboxyl group, an anhydride group, a sulfonic acid group, and an epoxy group (including a glycidyl group). Containing (a-2) component improves the impact resistance of (A) the polyamide resin composition, and thus the durability of the golf ball is improved.

(a-1) The polyamide resin contained in (A) the polyamide resin composition will be explained. (a-1) The polyamide resin is not limited, as long as it is a polymer having plurality of amide bonds (—NH—CO—) in a main molecular chain. Examples of (a-1) the polyamide resin include a product having an amide bond formed by a ring-opening polymerization of lactam or a reaction between a diamine component and a dicarboxylic acid component.

Examples of the lactam include ϵ-caprolactam, undecane lactam, and lauryl lactam. Examples of the diamine include hexamethylenediamine, nonanediamine, methylpentadiamine, p-phenylenediamine, m-phenylenediamine, p-xylylenediamine, and m-xylylenediamine. Examples of the dicarboxylic acid include adipic acid, azelaic acid, sebacic acid, terephthalic acid, and isophthalic acid.

Examples of (a-1) the polyamide resin are, an aliphatic polyamide such as polyamide 6, polyamide 11, polyamide 12, polyamide 66, polyamide 610, polyamide 6T, polyamide 6I, polyamide 9T, polyamide MST, polyamide 612; an aromatic polyamide such as poly-p-phenyleneterephthalamide, poly-m-phenyleneisophthalamide; an amide copolymer such as a polyetherblock amide copolymer, a polyester amide copolymer, a polyether-ester amide copolymer, a polyamideimide copolymer. These polyamides may be used individually or in combination of at least two of them. Among them, the aliphatic polyamide such as polyamide 6, polyamide 66, polyamide 11, polyamide 12 is preferable.

Specific examples of (a-1) the polyamide resin include, "Rilsan (registered trademark) B (for example, Rilsan BESN TL, Rilsan BESN P20 TL, Rilsan BESN P40 TL, Rilsan MB3610, Rilsan BMF O, Rilsan BMN O, Rilsan BMN O TLD, Rilsan BMN BK TLD, Rilsan BMN P20 D, Rilsan BMN P40 Dr available from Arkema Inc.

(a-2) The resin having at least one functional group selected from the group consisting of a hydroxyl group, a carboxyl group, an anhydride group, a sulfonic acid group, and an epoxy group (including a glycidyl group) (hereinafter, sometimes merely referred to as "(a-2) functional group-containing resin") contained in (A) the polyamide resin composition will be explained.

(a-2) The functional group-containing resin is not limited, as long as it has at least one functional group selected from the group consisting of a hydroxyl group (—OH), a carboxyl group (—COOH), an anhydride group (—CO—O—CO—), a sulfonic acid group (—$SO_3H$), and an epoxy group (—COC—) (including a glycidyl group). It is noted that (a-2) the functional group-containing resin does not include (B) an ethylene-(meth)acrylic acid binary copolymer, a metal-neutralized product of the ethylene-(meth)acrylic acid binary copolymer, an ethylene-(meth)acrylic acid-(meth)acrylic acid ester ternary copolymer, and a metal-neutralized product of the ethylene-(meth)acrylic acid-(meth)acrylic acid ester ternary copolymer described later.

(a-2) The functional group-containing resin is preferably, for example, without limitation, a thermoplastic elastomer. Examples of the thermoplastic elastomer include a thermoplastic polyolefin elastomer, a thermoplastic polyester elastomer, a thermoplastic polyamide elastomer, a thermoplastic polyurethane elastomer, and a thermoplastic styrene elastomer. Among them, the thermoplastic styrene elastomer is preferable.

The thermoplastic polyolefin elastomer preferably contains ethylene as a component. Examples of the thermoplastic polyolefin elastomer having a functional group include an ethylene-glycidyl (meth)acrylate copolymer, an ethylene-(meth)acrylic acid ester-glycidyl (meth)acrylate copolymer, and an ethylene-glycidyl (meth)acrylate-vinyl acetate copolymer The thermoplastic styrene elastomer is preferably a hydrogenated product of a block copolymer consisting of a polystyrene block and a block mainly composed of a conjugated diene compound. Herein, a hydrogenated product of the block copolymer means that at least a part of unsaturated bonds derived from the conjugated diene compound in the block copolymer is hydrogenated. The thermoplastic styrene elastomer preferably includes a hydrogenated product (styrene-ethylene-butylene-styrene block polymer (SEBS)) of a block copolymer using 1,3-butadiene as the conjugated diene compound, and a hydrogenated product (styrene-ethylene/propylene-styrene (SEPS)) of a block copolymer using 2-methyl-1,3-butadiene as the conjugated diene compound.

Specific examples of (a-2) the resin having a functional group include thermoplastic styrene elastomers such as "LOTARDER AX8840" manufactured by Arkema Inc., "ARUFON (registered trademark) UG-4030" manufactured by Toagosei Co., Ltd., "Bond Fast (registered trademark) E" manufactured by Sumitomo Chemical Co., Ltd., "Tuftec (registered trademark) M1913 and Tuftec M1943" manufactured by Asahi Kasei Corporation, "FUSABOND (registered trademark) NM052D" manufactured by E.I. du Pont de Nemours and Company, "Dynaron (registered trademark) 4630P" manufactured by JSR Corporation. Specific examples of (A) the polyamide resin composition include "NOVAMID (registered trademark) ST120" available from Mitsubishi Engineering-Plastics Company.

The content of (A) the polyamide resin composition in the resin component contained in the high fluidity intermediate layer composition is preferably 5 mass % or more, more preferably 10 mass % or more, and even more preferably 15 mass % or more, and is preferably 50 mass % or less, more preferably 45 mass % or less, and even more preferably 40 mass % or less. If the content of (A) the polyamide resin composition in the resin component contained in the high fluidity intermediate layer composition is 5 mass % or more, the modulus of the intermediate layer becomes high. Thus, the effect of the high launch angle and low spin rate becomes larger. On the other hand, if the content of (A) the polyamide resin composition is 50 mass % or less, the modulus of the intermediate layer does not become excessively high. Thus, the resultant golf ball has better shot feeling and durability.

Next, (B) at least one member selected from the group consisting of an ethylene-(meth)acrylic acid binary copolymer, a metal-neutralized product of the ethylene-(meth) acrylic acid binary copolymer, an ethylene-(meth)acrylic acid-(meth)acrylic acid ester ternary copolymer, and a metal-neutralized product of the ethylene-(meth)acrylic acid-(meth)acrylic acid ester ternary copolymer (hereinafter, sometimes merely referred to as "(B) copolymer and/or a metal-neutralized product thereof") will be explained.

The ethylene-(meth)acrylic acid binary copolymer (hereinafter, sometimes merely referred to as "binary copolymer") is a copolymer obtained by copolymerizing a monomer composition containing ethylene and (meth)acrylic acid. The ethylene-(meth)acrylic acid-(meth)acrylic acid ester ternary copolymer (hereinafter, sometimes merely referred to as "ternary copolymer") is a copolymer obtained by copolymerizing a monomer composition containing ethylene, (meth)acrylic acid, and (meth)acrylic acid ester. Examples of (meth)acrylic acid ester include methyl (meth)acrylate, ethyl (meth)acrylate, isopropyl (meth)acrylate, isobutyl (meth)acrylate, n-butyl (meth)acrylate, pentyl (meth)acrylate, hexyl (meth)acrylate, heptyl (meth)acrylate, isooctyl (meth)acrylate, and 2-ethylhexyl (meth)acrylate.

The content of the (meth)acrylic acid component in the binary copolymer or the ternary copolymer is preferably 2 mass % or more, more preferably 3 mass % or more, and is preferably 30 mass % or less, more preferably 25 mass % or less.

The binary copolymer or the ternary copolymer may be obtained by copolymerizing another monomer to the extent that the effect of the present invention is not impaired. Examples of another monomer are a vinyl ester such as vinyl acetate, vinyl propionate; an unsaturated carboxylate such as dimethyl maleate, diethyl maleate; carbon monoxide, sulfur dioxide. In the case that another monomer is used, the content of another monomer in the binary copolymer or the ternary copolymer is preferably 40 mass % or less, more preferably 30 mass % or less, even more preferably 20 mass % or less.

Specific examples of (B) the binary copolymer or the ternary copolymer include "NUCREL (registered trademark) (e.g. binary copolymers such as NUCREL AN4214C, NUCREL AN4225C, NUCREL AN42115C, NUCREL N0903HC, NUCREL N0908C, NUCREL AN42012C, NUCREL N410, NUCREL N1035, NUCREL N1050H, NUCREL N1108C, NUCREL N1110H, NUCREL N1207C, NUCREL N1214, NUCREL AN4221C, NUCREL N1525, NUCREL N1560, NUCREL N0200H, NUCREL AN4228C, NUCREL N4213C, NUCREL N035C; ternary copolymers such as NUCREL AN4311, NUCREL AN4318) manufactured by Du Pont-Mitsui Polychemicals Co.

The metal-neutralized product of the ethylene-(meth) acrylic acid binary copolymer (hereinafter, sometimes merely referred to as "metal-neutralized binary copolymer") is a metal-neutralized product obtained by neutralizing at least a part of carboxyl groups of the binary copolymer with a metal ion. The metal-neutralized product of the ethylene-(meth)acrylic acid-(meth)acrylic acid ester ternary copolymer (hereinafter, sometimes merely referred to as "metal-neutralized ternary copolymer") is a metal-neutralized product obtained by neutralizing at least a part of carboxyl groups of the ternary copolymer with a metal ion.

Examples of a metal (ion) used for the metal-neutralized binary or ternary copolymers include: monovalent metals (ions) such as sodium, potassium, lithium, or the like; divalent metals (ions) such as magnesium, calcium, zinc, barium, cadmium, or the like; trivalent metals (ions) such as aluminum or the like; and other metals (ions) such as tin, zirconium, or the like. Among these metals (ions), sodium, zinc and magnesium (ions) are preferably used because they provide excellent resilience, durability, or the like.

The degree of neutralization of the acidic groups contained in the metal-neutralized binary or ternary copolymers is preferably 20 mole % or more, more preferably 30 mole % or more, and is preferably 90 mole % or less, more preferably 85 mole % or less. The degree of neutralization of the acidic groups in the metal-neutralized binary or ternary copolymers can be calculated by using the following mathematical expression 1.

Degree of neutralization (mol %)=(the number of moles of acidic groups neutralized in a metal neutralized copolymer/the number of moles of all acidic groups contained in the metal neutralized copolymer)×100 [Mathematical Expression 1]

Specific examples of the metal-neutralized binary or ternary copolymers include trade name "Himilan (registered trademark) (e.g. the binary copolymerized ionomer such as Himilan 1555 (Na), Himilan 1557 (Zn), Himilan 1605 (Na), Himilan 1706 (Zn), Himilan 1707 (Na), Himilan AM7311 (Mg); and the ternary copolymerized ionomer such as Himilan 1856 (Na), Himilan 1855 (Zn))" commercially available from Du Pont-Mitsui Polychemicals Co., Ltd.

Further, examples include "Surlyn (registered trademark) (e.g. the binary copolymerized ionomer such as Surlyn 8945 (Na), Surlyn 9945 (Zn), Surlyn 8140 (Na), Surlyn 8150 (Na), Surlyn 9120 (Zn), Surlyn 9150 (Zn), Surlyn 6910 (Mg), Surlyn 6120 (Mg), Surlyn 7930 (Li), Surlyn 7940 (Li), Surlyn AD8546 (Li); and the ternary copolymerized ionomer such as Surlyn 6320 (Mg), Surlyn 8120 (Na), Surlyn 8320 (Na), Surlyn 9320 (Zn))" and the ternary copolymerized ionomer such as "HPF 1000 (Mg), HPF 2000 (Mg)" commercially available from E.I. du Pont de Nemours and Company.

Further, examples include "lotek (registered trademark) (e.g. the binary copolymerized ionomer such as lotek 8000 (Na), lotek 8030 (Na), lotek 7010 (Zn), lotek 7030 (Zn); and the ternary copolymerized ionomer such as lotek 7510 (Zn), lotek 7520 (Zn))" commercially available from ExxonMobil Chemical Corporation.

The metal-neutralized binary or ternary copolymers may be used alone or as a mixture of at least two of them. It is noted that Na, Zn, Li, and Mg described in the parentheses after the trade names indicate metal types of neutralizing metal ions for the metal-neutralized copolymer.

As (B) the copolymer and/or a metal-neutralized product thereof used in the present invention, preferred is the metal-neutralized product of the ethylene-(meth)acrylic acid binary copolymer or the ethylene-(meth)acrylic acid-(meth)acrylic acid ester ternary copolymer, which is neutralized with at least one metal ion selected from the group consisting of Li, Na, Ca, Zn, Mg and Cu.

The flexural modulus of (B) the copolymer and/or a metal-neutralized product thereof is preferably 150 MPa or more, more preferably 170 MPa or more, and even more preferably 190 MPa or more, and is preferably 1,000 MPa or less, more preferably 800 MPa or less, and even more preferably 600 MPa or less. If the flexural modulus of (B) the copolymer and/or a metal-neutralized product thereof is too low, the elastic modulus of the intermediate layer becomes low, and the effects of increasing the launch angle and reducing the spin rate become small. On the other hand, if the flexural modulus of (B) the copolymer and/or a metal-neutralized product thereof is too high, the elastic modulus of the intermediate layer becomes excessively high, and the durability and the shot feeling of the golf ball deteriorate.

The content of (B) the copolymer and/or a metal-neutralized product thereof in the resin component constituting the high fluidity intermediate layer composition is preferably 50 mass % or more, more preferably 55 mass % or more, even more preferably 60 mass % or more, and is preferably 95 mass % or less, more preferably 90 mass % or less, and even more preferably 85 mass % or less. If the content of (B) the copolymer and/or a metal-neutralized product thereof in the resin component constituting the high fluidity intermediate layer composition is 50 mass % or more, the repulsion and the durability of the golf ball becomes better. On the other hand, if the content of (B) the copolymer and/or a metal-neutralized product thereof is 95 mass % or less, the elastic modulus of the intermediate layer can be made in an appropriate range, and hence the effects of increasing the launch angle and reducing the spin rate becomes larger.

The content ratio ((A)/(B)) of (A) the polyamide resin composition to (B) the copolymer and/or a metal-neutralized product thereof (the total is 100 mass %) in the high fluidity intermediate layer composition is preferably 5 mass %/95 mass % to 50 mass %/50 mass %. If the content ratio of (A) the polyamide resin composition to (B) the copolymer and/or a metal-neutralized product thereof falls within the above range, the intermediate layer has a desired elastic modulus, and the launch angle is increased and the spin rate is reduced, thereby improving the flight distance of the golf ball. The content ratio ((A)/(B)) of (A) the polyamide resin composition to (B) the copolymer and/or a metal-neutralized product thereof (the total is 100 mass %) in the high fluidity intermediate layer composition is more preferably 10 mass %/90 mass % to 45 mass %/55 mass % and even more preferably 15 mass %/85 mass % to 40 mass %/60 mass %.

The high fluidity intermediate layer composition preferably consists of (A) the polyamide resin composition, and (B) the copolymer and/or a metal-neutralized product thereof as a resin component, but may contain another resin component in addition to (A) the polyamide resin composition, and (B) the copolymer and/or a metal-neutralized product thereof, as long as another resin component does not impair the effects of the present invention.

The high fluidity intermediate layer composition may further contain pigment components such as a white pigment (for example, titanium oxide), a blue pigment, and a red pigment; a specific gravity adjusting agent such as barium sulfate, tungsten and the like; a dispersant; an antioxidant; an ultraviolet absorber; a light stabilizer; a fluorescent material or a fluorescent brightener or the like, as long as they do not impair the effect of the present invention.

The amount of the white pigment (for example, titanium oxide), with respect to 100 parts by mass of the resin component, is preferably 0.5 part by mass or more and more preferably 1 part by mass or more, and is preferably 10 parts by mass or less and more preferably 8 parts by mass or less. If the amount of the white pigment is 0.5 part by mass or more, it is possible to provide opacity to the intermediate layer. If the amount of the white pigment is more than 10 parts by mass, the durability of the resultant intermediate layer may deteriorate.

In a process for producing the golf ball of the present invention, (A) the polyamide resin composition, and (B) the copolymer and/or a metal-neutralized product thereof, if necessary an additive, are blended to obtain a high fluidity intermediate layer composition. For this blending of the high fluidity intermediate layer composition, for example, it is preferable to use a mixer capable of blending pellet materials, and it is more preferable to use a tumbler mixer. Embodiments for blending the high fluidity intermediate layer composition include an embodiment in which (A) the polyamide resin composition, (B) the copolymer and/or a metal-neutralized product thereof, and an additive such as titanium oxide or the like are blended and extruded to prepare a pellet; and an embodiment in which an additive such as titanium oxide or the like is blended with (B) the copolymer and/or a metal-neutralized product thereof and extruded to prepare a white pellet in advance, then the white pellet and the pellet of (A) the polyamide resin composition are dry-blended.

The core used in the golf ball of the present invention will be described. The core used in the present invention is not limited, as long as the core consists of a center and one or more intermediate layers covering the center.

The core of the golf ball of the present invention includes, for example, a core consisting of a center and a single-layered intermediate layer covering the center, a core consisting of a center and multi-piece or multi-layer of intermediate layers covering the center. The core preferably has a spherical shape. If the core does not have a spherical shape, the cover does not have a uniform thickness. As a result, there exist some portions where the performance of the cover is lowered. On the other hand, the center generally has the spherical shape, but the center may be provided with a rib on the surface thereof so that the surface of the spherical center is divided by the ribs. For example, the surface of the spherical center is evenly divided by the ribs. In one embodiment, the ribs are preferably formed on the surface of the spherical center in an integrated manner, and in another embodiment, the ribs are formed as an intermediate layer on the surface of the spherical center.

The ribs are preferably formed along an equatorial line and meridians that evenly divide the surface of the spherical center, if the spherical center is assumed as the earth. For example, if the surface of the spherical center is evenly divided into 8, the ribs are formed along the equatorial line, any meridian as a standard, and meridians at the longitude 90 degrees east, longitude 90 degrees west, and the longitude 180 degrees east(west), assuming that the meridian as the standard is at longitude 0 degree. If the ribs are formed, the depressed portion divided by the ribs are preferably filled with a plurality of intermediate layers or with a single-layered intermediate layer that fills each of the depressed portions to make a core in the spherical shape. The shape of the ribs, without limitation, includes an arc or an almost arc (for example, a part of the arc is removed to obtain a flat surface at the cross or orthogonal portions thereof).

When the depressed portions divided by the ribs provided on the surface of the center are preferably filled with a plurality of intermediate layers, at least one piece of the plurality of intermediate layers is formed from the high fluidity intermediate layer composition. It is noted that when the core consists a center and multi-piece of intermediate layers or multi-layer of intermediate layers covering the center, the core may include an intermediate layer which is formed from an intermediate layer composition different from the high fluidity intermediate layer composition, as long as it does not impair the effects of the present invention. In this case, it is preferred that the outermost layer of the core is an intermediate layer formed from the high fluidity intermediate layer composition, and it is preferred that all the multi-piece of intermediate layers or multi-layer of intermediate layers are formed from the high fluidity intermediate layer composition.

Examples of the intermediate layer composition which is different from the high fluidity intermediate layer composition include, a rubber composition described later, the ionomer resin described above, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic polyurethane elastomer having a trade name "Elastollan (registered trademark) (e.g. "Elastollan XNY97A")" commercially available from BASF Japan Ltd., a thermoplastic polystyrene elastomer having a trade name "Rabalon (registered trademark)" commercially available from Mitsubishi Chemical Corporation, and the like. These resin components may be used alone or in combination of two or more thereof. In addition, the intermediate layer composition may contain a specific gravity adjusting agent such as barium sulfate, tungsten, and the like, an antioxidant, a pigment, and the like.

One example of the process for forming the intermediate layer is to cover the center with the intermediate layer composition to form an intermediate layer.

The process for forming the intermediate layer is not particularly limited. In one embodiment, the intermediate layer composition is molded into hemispherical half shells in advance, and then the center is covered with two half shells and press-molded at the temperature of 130° C. to 170° C. for 1 to 5 minutes. In another embodiment, the intermediate layer composition is injection-molded directly onto the center so as to cover the center.

As the center of the golf ball of the present invention, a conventionally known rubber composition (hereinafter simply referred to as "center rubber composition" occasionally) may be employed, and it can be molded by, for example, heat-pressing a rubber composition containing a base rubber, a crosslinking initiator, a co-crosslinking agent, and a filler.

As the base rubber, a natural rubber and/or a synthetic rubber such as a polybutadiene rubber, a natural rubber, a polyisoprene rubber, a styrene polybutadiene rubber, and ethylene-propylene-diene terpolymer (EPDM) may be used. Among them, typically preferred is the high cis-polybutadiene having cis-1,4-bond in a proportion of 40% or more, more preferably 70% or more, even more preferably 90% or more in view of its superior repulsion property.

The crosslinking initiator is blended to crosslink the base rubber component. As the crosslinking initiator, an organic peroxide is preferably used. Examples of the organic peroxide for use in the present invention are dicumyl peroxide, 1,1-bis(t-butylperoxy)-3,5-trimethylcyclohexane, 2,5-dimethyl-2,5-di(t-butylperoxy)hexane, and di-t-butyl peroxide. Among them, dicumyl peroxide is preferable. An amount of the crosslinking initiator to be blended in the rubber composition is preferably 0.3 part by mass or more, more preferably 0.4 part by mass or more, and is preferably 5 parts by mass or less, more preferably 3 parts by mass or less based on 100 parts by mass of the base rubber. If the amount is less than 0.3 part by mass, the core becomes too soft, and the resilience tends to be lowered, and if the amount is more than 5 parts by mass, the amount of the co-crosslinking agent must be increased in order to obtain the appropriate hardness, and thus the repulsion is likely to be lowered.

The co-crosslinking agent is not particularly limited as long as it has the effect of crosslinking a rubber molecule by graft polymerization with a base rubber molecular chain; for example, α,β-unsaturated carboxylic acid having 3 to 8 carbon atoms or a metal salt thereof, more preferably acrylic acid, methacrylic acid or a metal salt thereof may be used. As the metal constituting the metal salt, for example, zinc, magnesium, calcium, aluminum and sodium may be used, and among them, zinc is preferred because it provides high resilience.

The amount of the co-crosslinking agent to be used is preferably 10 parts or more, more preferably 15 parts or more, even more preferably 20 parts or more, and is preferably 55 parts or less, more preferably 50 parts or less, even more preferably 48 parts or less based on 100 parts of the base rubber by mass. If the amount of the co-crosslinking agent to be used is less than 10 parts by mass, the amount of the crosslinking initiator must be increased to obtain an appropriate hardness, which tends to lower the resilience. On the other hand, if the amount of the co-crosslinking agent to be used is more than 55 parts by mass, the center becomes too hard, so that the shot feeling may be lowered.

The filler contained in the center rubber composition is mainly blended as a specific gravity adjusting agent in order to adjust the specific gravity of the golf ball obtained as the final product in the range of 1.0 to 1.5, and may be blended as required. Examples of the filler include an inorganic filler such as zinc oxide, barium sulfate, calcium carbonate, magnesium oxide, tungsten powder, and molybdenum powder. The amount of the filler to be blended in the rubber composition is preferably 0.5 part or more, more preferably 1 part or more, and preferably 30 parts or less, more preferably 20 parts or less based on 100 parts of the base rubber by mass. If the amount of the filler to be blended is less than 0.5 part by mass, it becomes difficult to adjust the weight, while if it is more than 30 parts by mass, the weight ratio of the rubber component becomes small and the resilience tends to be lowered.

As the center rubber composition, an organic sulfur compound, an antioxidant or a peptizing agent may be blended appropriately in addition to the base rubber, the crosslinking initiator, the co-crosslinking agent and the filler.

As the organic sulfur compound, diphenyl disulfide or a derivative thereof may be preferably used. Examples of the diphenyl disulfide or the derivative thereof include diphenyl disulfide; a mono-substituted diphenyl disulfide such as bis (4-chlorophenyl) disulfide, bis(3-chlorophenyl) disulfide, bis (4-bromophenyl) disulfide, bis(3-bromophenyl) disulfide, bis (4-fluorophenyl) disulfide, bis(4-iodophenyl) disulfide and bis(4-cyanophenyl) disulfide; a di-substituted diphenyl disulfide such as bis(2,5-dichlorophenyl) disulfide, bis(3,5-dichlorophenyl) disulfide, bis(2,6-dichlorophenyl) disulfide, bis(2,5-dibromophenyl) disulfide, bis (3,5-dibromophenyl) disulfide, bis(2-chloro-5-bromophenyl) disulfide, and bis(2-cyano-5-bromophenyl) disulfide; a tri-substituted diphenyl disulfide such as bis (2,4,6-trichlorophenyl) disulfide, and bis(2-cyano-4-chloro-6-bromophenyl) disulfide; a tetra-substituted diphenyl disulfide such as bis(2,3,5,6-tetra chlorophenyl) disulfide; a penta-substituted diphenyl disulfide such as bis (2,3,4,5,6-pentachlorophenyl) disulfide and bis(2,3,4,5,6-pentabromophenyl) disulfide. These diphenyl disulfides or the derivative thereof can enhance resilience by having some influence on the state of vulcanization of vulcanized rubber. Among them, diphenyl disulfide and bis(pentabromophenyl) disulfide are preferably used since a golf ball having particularly high resilience can be obtained. The amount of the diphenyl disulfide or the derivative thereof to be blended is preferably 0.1 part by mass or more, more preferably 0.3 part by mass or more, and is preferably 5.0 parts by mass or less, more preferably 3.0 parts by mass or less relative to 100 parts by mass of the base rubber.

The amount of the antioxidant to be blended is preferably 0.1 part or more and is preferably 1 part or less based on 100 parts of the base rubber by mass. Further, the amount of the peptizing agent is preferably 0.1 part or more and is preferably 5 parts or less based on 100 parts of the base rubber by mass.

The center can be obtained by mixing, kneading the above mentioned rubber composition and molding the rubber composition in the mold. The conditions for press-molding the center rubber composition should be determined depending on the rubber composition. Specifically, the press-molding is preferably carried out for 10 to 60 minutes at the temperature of 130° C. to 200° C. Alternatively, the press-molding is preferably carried out in a two-step heating, for example, for 20 to 40 minutes at the temperature of 130° C. to 150° C., and continuously for 5 to 15 minutes at the temperature of 160° C. to 180° C.

The diameter of the center is preferably 25 mm or more and more preferably 30 mm or more, and is preferably 41 mm or less and more preferably 40 mm or less. If the diameter of the center is less than 25 mm, the thickness of the intermediate layer or the cover needs to be greater than a desired thickness, and hence the resilience may deteriorate. On the other hand, if the diameter of the center exceeds 41 mm, the thickness of the intermediate layer or the cover needs to be smaller than the desired thickness, and hence the intermediate layer or the cover may not function well.

When the center has a diameter in a range from 25 mm to 41 mm, a compression deformation amount of the center (an compression amount of the center in the compression direction thereof) when applying an initial load of 98 N to a final load of 1275 N is preferably 1.5 mm or more and more preferably 2.0 mm or more, and is preferably 5.0 mm or less and more preferably 4.0 mm or less. If the compression deformation amount is less than 1.5 mm, the shot feeling may become hard and deteriorate. If the compression deformation amount exceeds 5.0 mm, the repulsion may deteriorate.

The surface hardness Hs1 in Shore D hardness of the center is preferably 40 or more, more preferably 48 or more, and even more preferably 54 or more, and is preferably 75 or less, more preferably 67 or less, and even more preferably 64 or less. If the surface hardness Hs1 in Shore D hardness of the center is less than 40, the golf ball becomes excessively soft and the repulsion may deteriorate, thereby decreasing the flight distance. On the other hand, if the surface hardness Hs1 in Shore D hardness of the center is more than 75, the golf ball becomes excessively hard and the shot feeling may deteriorate.

The diameter of the core of the golf ball of the present invention is preferably 30 mm or more, more preferably 35 mm or more, and even more preferably 37 mm or more. If the diameter of the core is less than 30 mm, the cover becomes excessively thick and thus the repulsion may deteriorate. Further, the diameter of the core is preferably 42.2 mm or less, more preferably 42.0 mm or less, and even more preferably 41.8 mm or less. If the diameter of the core is more than 42.2 mm, the cover becomes relatively thin and a protection effect of the cover is not sufficiently obtained.

When the core has a diameter in a range from 30 mm to 42.2 mm, a compression deformation amount of the core (an compression amount of the core in the compression direction thereof) when applying an initial load of 98 N to a final load of 1275 N is preferably 1.5 mm or more and more preferably 2.0 mm or more, and is preferably 5.0 mm or less and more preferably 4.0 mm or less. If the compression deformation amount is less than 1.5 mm, the shot feeling may become hard and deteriorate. If the compression deformation amount exceeds 5.0 mm, the resilience may deteriorate.

It is preferable that the core of the present invention has a larger surface hardness Hs than the center hardness Ho. The hardness difference (Hs−Ho) between the surface hardness Hs and the center hardness Ho of the core in the golf ball of the present invention is preferably 10 or larger, more preferably 15 or larger in Shore D hardness. Making the surface hardness of the core larger than the center hardness increases the launch angle and reduces the spin rate, thereby improving the flight distance. The hardness difference (Hs−Ho) between the surface hardness Hs and the center hardness Ho of the core is, without limitation, preferably 55 or less, more preferably 50 or less in Shore D. If the hardness difference is too large, the durability of the golf ball tends to be lower.

The center hardness Ho of the core is preferably 20 or larger, more preferably 27 or larger, and even more preferably 32 or larger in Shore D hardness. If the center hardness Ho is 20 or larger in Shore D hardness, the core does not become too soft, resulting in the good repulsion. The center hardness Ho of the core is preferably 60 or smaller, more preferably 53 or smaller, and even more preferably 48 or smaller in Shore D. If the center hardness Ho is 60 or less in Shore D hardness, the core does not become too hard, resulting in the good shot feeling. In the present invention, the center hardness Ho of the core is the hardness measured with the Shore D type spring hardness tester at the central point of a cut plane of a core which has been cut into two halves.

The surface hardness Hs of the core is preferably 60 or more, more preferably 61 or more, and even more preferably 62 or more, and is preferably 68 or less, more preferably 67 or less, even more preferably 66 or less in Shore D hardness. If the surface hardness Hs is 60 or more in Shore D hardness, the effect of increasing launch angle and reducing spin rate becomes larger, while if the surface hardness Hs is 68 or less in Shore D hardness, the core does not become too hard, and the durability would be better.

The following will describe the cover of the golf ball of the present invention. The cover of the golf ball of the present invention contains a polyurethane as a resin component, and has a slab hardness of 85 or less in JIS-A hardness.

The polyurethane is not particularly limited, as long as it has a plurality of urethane bonds within the molecule. For example, the polyurethane is a reaction product obtained by reacting a polyisocyanate component with a high-molecular-weight polyol component to have urethane bonds formed within the molecule. Further, a chain extension reaction with a low-molecular-weight polyol, a low-molecular-weight polyamine, or the like is performed if necessary. The polyurethane includes a thermosetting polyurethane and thermoplastic polyurethane. The polyurethane is preferably a thermoplastic polyurethane. Specific examples of the polyurethane resin include Elastollan (registered trademark) XNY85A, XNY83A, XNY 75A, XNY70A, and XNY68A manufactured by BASF Japan Ltd., and the like.

The cover composition for forming the cover of the golf ball of the present invention preferably consists of polyurethane as a resin component, but may further contain another resin to the extent that the effect of the present invention does not deteriorate. In this case, the content of the polyurethane in the resin component is preferably 50 mass % or more, more preferably 60 mass % or more, and even more preferably 70 mass % or more.

Examples of the other resin components include an ionomer resin, a thermoplastic polyamide elastomer having a trade name "Pebax (registered trademark) (e.g. "Pebax 2533")" commercially available from Arkema Inc., a thermoplastic polyester elastomer having a trade name "Hytrel (registered trademark) (e.g. "Hytrel 3548" and "Hytrel 4047")" commercially available from Du Pont-Toray Co., Ltd., a thermoplastic styrene elastomer having a trade name "Rabalon (registered trademark)", and a thermoplastic polyester elastomer having a trade name "Primalloy (registered trademark)" commercially available from Mitsubishi Chemical Corporation. These resin components may be used solely or in combination of two or more types thereof.

In the present invention, in addition to the aforementioned resin component, the cover may contain a pigment component such as a white pigment (for example, titanium oxide), a blue pigment, a red pigment, or the like, a specific gravity adjusting agent such as zinc oxide, calcium carbonate, barium sulfate, or the like, a dispersant, an antioxidant, an ultraviolet absorber, a light stabilizer, a fluorescent material or a fluorescent brightener, or the like as long as they do not impair the performance of the cover.

The amount of the white pigment (for example, titanium oxide), with respect to 100 parts by mass of the resin component for forming the cover, is preferably 0.5 part by mass or more and more preferably 1 part by mass or more, and is preferably 10 parts by mass or less and more preferably 8 parts by mass or less. If the amount of the white pigment is 0.5 part by mass or more, it is possible to provide opacity to the cover. If the amount of the white pigment is more than 10 parts by mass, the durability of the resultant cover may deteriorate.

The slab hardness of the cover of the golf ball of the present invention is preferably 85 or less, more preferably 84 or less, and even more preferably 83 or less in JIS-A hardness. If the slab hardness of the cover is 85 or less in JIS-A hardness, the spin rate increases upon an approach shot. On the other hand, if the hardness of the cover is too low, the spin rate may increase upon a driver shot. Thus, the slab hardness of the cover is preferably 60 or more, more preferably 65 or more, and even more preferably 70 or more. The slab hardness of the cover is a slab hardness obtained by measuring the hardness of the cover composition molded into a sheet form.

An embodiment for molding a cover is not particularly limited, and includes an embodiment which comprises injection molding the cover composition directly onto the core, or an embodiment which comprises molding the cover composition into a hollow-shell, covering the core with a plurality of the hollow-shells and subjecting the core with a plurality of the hollow shells to the compression-molding (preferably an embodiment which comprises molding the cover composition into a half hollow-shell, covering the core with the two half hollow-shells, and subjecting the core with the two half hollow-shells to the compression-molding). In the case of directly injection molding the cover composition onto the core, it is preferred to use upper and lower molds for forming a cover having a spherical cavity and pimples, wherein a part of the pimple also serves as a retractable hold pin. When forming the cover by injection molding, the hold pin is protruded to hold the core, and the cover composition which has been heated and melted is charged and then cooled to obtain a cover. For example, the cover composition heated and melted at the temperature of 150° C. to 230° C. is charged into a mold held under the pressure of 980 KPa to 1,500 KPa for 0.1 to 1 second. After cooling for 15 to 60 seconds, the mold is opened and the golf ball with the cover molded is taken out from the mold.

When molding the cover in a compression molding method, molding of the half shell can be performed by either compression molding method or injection molding method, and the compression molding method is preferred. The compression-molding of the cover composition into a half shell can be carried out, for example, under a pressure of 1 MPa or more and 20 MPa or less at a temperature of −20° C. or more and 70° C. or less relative to the flow beginning temperature of the cover composition. By performing the molding under the above conditions, a half shell having a uniform thickness can be formed. Examples of a method for molding the cover using half shells include compression molding by covering the core with two half shells. The compression molding of half shells into the cover can be carried out, for example, under a pressure of 0.5 MPa or more and 25 MPa or less at a temperature of −20° C. or more and 70° C. or less relative to the flow beginning temperature of the cover composition. By performing the molding under the above conditions, a cover for a golf ball having a uniform thickness can be formed.

The molding temperature means the highest temperature where the temperature at the surface of the concave portion of the lower mold reaches from closing through opening the molds. Further, the flow beginning temperature of the cover material can be measured in a pellet form with the following conditions by using a flow characteristics evaluation apparatus (Flow Tester CFT-500D, manufactured by Shimadzu Corporation).

Measuring conditions: Area size of a plunger: 1 $cm^2$, Die length: 1 mm, Die diameter: 1 mm, Load: 588.399 N, Start temperature: 30° C., and Temperature increase rate: 3° C./min.

When molding a cover, the concave portions called "dimple" are usually formed on the surface. The total number of the dimples formed on the cover is preferably 200 or more and 500 or less. If the total number is less than 200, the dimple effect is hardly obtained. On the other hand, if the total number exceeds 500, the dimple effect is hardly obtained because the size of the respective dimples is small. The shape (shape in a plan view) of dimples includes, for example, without limitation, a circle, polygonal shapes such as roughly triangular shape, roughly quadrangular shape, roughly pentagonal shape, and roughly hexagonal shape, another irregular shape. The shape of the dimples is employed solely or in combination at least two of them.

After the cover is molded, the mold is opened and the golf ball body is taken out from the mold, and as necessary, the golf ball body is preferably subjected to surface treatments such as deburring, cleaning, and sandblast. If desired, a paint film or a mark may be formed. The paint film preferably has a thickness of, but not limited to, 5 μm or larger, and more preferably 7 μm or larger, and preferably has a thickness of 25 μm or smaller, and more preferably 18 μm or smaller. If the thickness is smaller than 5 μm, the paint film is easy to wear off due to continued use of the golf ball, and if the thickness is larger than 25 μm, the effect of the dimples is reduced, resulting in deteriorating flying performance of the golf ball.

In the present invention, the thickness of the cover of the golf ball is preferably 3 mm or less, more preferably 2.5 mm or less, and even more preferably 2 mm or less. If the thickness of the cover is 3 mm or less, the repulsion and shot feeling become better. The thickness of the cover is preferably 0.1 mm or more, more preferably 0.2 mm or more, and even more preferably 0.3 mm or more. If the thickness of the cover is less than 0.1 mm, it becomes difficult to mold the cover. In addition, the durability and the abrasion resistance of the cover may deteriorate.

The golf ball of the present invention can have various structures, as long as it includes: a core consisting of a center and one or more intermediate layers covering the center; and a cover covering the core. Specific examples of the golf ball of the present invention include a three-piece golf ball comprising a core consisting of a center and an intermediate layer covering the center, and a cover covering the core; a four-piece golf ball comprising a core consisting of a center and two intermediate layers covering the center, and a cover covering the core; and a multi-piece golf ball comprising a core consisting of a center and multi-piece of intermediate layers or multi-layer of intermediate layers covering the center, and a cover covering the core. Among them, the present invention is suitably applicable to a three-piece golf ball comprising a core consisting of a center and a single-layer intermediate layer covering the center, and a cover covering the core.

As the golf ball of the present invention, a three-piece golf ball, which includes: a core consisting of a center and a single-layer intermediate layer covering the center; and a cover covering the core, wherein the intermediate layer is formed from the high fluidity intermediate layer composition, is most preferable.

In the present invention, the intermediate layer formed from the high fluidity intermediate layer composition is regarded as a part of the core, but it may be deemed as an inner cover layer. That is, the golf ball of the present invention includes a three-piece golf ball including a single-layered core and two cover layers covering the core, wherein an inner cover is formed from the high fluidity intermediate layer composition.

When the golf ball of the present invention has a diameter in a range from 40 mm to 45 mm, a compression deformation amount of the golf ball (an amount of compression of the golf ball in the compression direction thereof) when applying an initial load of 98 N to a final load of 1275 N to the golf ball is preferably 2.0 mm or more, more preferably 2.1 mm or more, and even more preferably 2.2 mm or more, and is preferably 3.0 mm or less, more preferably 2.9 mm or less, and even more preferably 2.8 mm or less. If the compression deformation amount is 2.0 mm or more, desirable shot feeling is obtained. If the compression deformation amount is 3.0 mm or less, desirable repulsion is obtained.

EXAMPLES

Hereinafter, the present invention will be described in detail by way of example. The present invention is not limited to examples described below. Various changes and modifications can be made without departing from the spirit and scope of the present invention.

(1) Melt Flow Rate (MFR) (g/10 min)

The MFR was measured using a flow tester (Shimadzu flow tester CFT-100C manufactured by Shimadzu Corporation) in accordance with JIS K7210. The measurement was conducted under the conditions of the measurement temperature 240° C. and the load of 2.16 kg.

(2) Flexural Modulus (MPa) (3 Points Bending Test, MPa)

Test pieces with a length of 80.0±2 mm, a width of 10.0±0.2 mm, and a thickness of 4.0±0.2 mm were produced by injection molding the resin component constituting the intermediate layer, and immediately stored at 23° C.±2° C. for 24 hours or more in a moisture-proof container. The test pieces were taken out from the moisture-proof container and immediately (within 15 minutes) the flexural modulus of the test pieces were measured according to ISO178. The measurement was conducted at a temperature of 23° C. and a humidity of 50% RH.

(3) Slab Hardness (Shore D, JIS-A Hardness)

Sheets with a thickness of about 2 mm were produced by injection molding a cover composition or a resin component constituting the intermediate layer, and stored at 23° C. for two weeks. Three or more of these sheets were stacked on one another so as not to be affected by the measuring base on which the sheets were placed, and the stack was measured with a type P1 auto loading durometer manufactured by Kobunshi Keiki Co., Ltd., provided with a Shore D or JIS-A type spring hardness tester.

(4) Hardness of Center and Core (Shore D Hardness)

A type P1 auto loading durometer manufactured by Kobunshi Keiki Co., Ltd., provided with a Shore D type spring hardness tester prescribed in ASTM-D2240 standard was used to measure the surface hardness Hs1 of the center and the surface hardness Hs of the core. Shore D hardness measured at the surfaces of the center and the core were used as the surface hardness Hs1 of the center and the surface hardness Hs of the core, respectively. The core was cut into two hemispheres to obtain a cut plane, and a Shore D hardness measured at the center of the cut plane was used as the central hardness Ho of the center or the core.

(5) Compression Deformation Amount (mm)

A compression deformation amount of the core or the golf ball (a shrinking amount of the core or the golf ball in the compression direction thereof), when applying an initial load of 98 N to a final load of 1275 N, was measured.

(6) Durability

A metal-head W#1 driver (XXIO S shaft, loft: 11°, manufactured by SRI Sports Limited) was installed on a swing robot M/C manufactured by Golf Laboratories, Inc. Each golf ball was hit at a head speed of 45 m/sec. This procedure was repeated, and the number of hits required to break the golf ball was counted. It is noted that there was a case where the golf ball looks unbroken but a crack occurs in the intermediate layer. In such a case, whether or not the golf ball was broken was determined based on deformation of the golf ball and difference in sound at hitting of the golf ball. The number of hits for golf ball No. 4 was defined as an index of 100, and the durability of each golf ball was represented by converting the number of hits for each golf ball into this index. A greater index value indicates that the durability of the golf ball is excellent.

(7) Shot with a Driver

A metal-head W#1 driver (XXIO S shaft, loft: 11°, manufactured by SRI Sports Limited) was installed on a swing robot M/C manufactured by Golf Laboratories, Inc. A golf ball was hit at a head speed of 50 m/sec, and the speed of the golf ball immediately after the hit, the launch angle, the spin rate, and the flight distance (the distance from the launch point to the stop point) were measured. This measurement was conducted twelve times for each golf ball, and the average value was used as the measurement value for the golf ball. Regarding the speed of the golf ball immediately after the hit and the spin rate, a sequence of photographs of the hit golf ball were taken to measure the spin rate and the initial ball speed.

(8) Shot with an Approach Wedge

A sand wedge was installed on a swing robot M/C manufactured by Golf Laboratories, Inc. A golf ball was hit at a head speed of 21 m/sec. The measurement was conducted twelve times for each golf ball, and the average value was used as the spin rate. Regarding the spin rate of the golf ball immediately after the hitting, a sequence of photographs of the hit golf ball were taken to determine the spin rate. The range of the spin rate is the difference between the maximum value and the minimum value among the spin rates of twelve times. A narrower range of the spin rate indicates that the spin stability is high.

Evaluation Criteria for Range of Spin Rate

A: The range is less than 100 rpm.

B: The range is 100 rpm or more and less than 200 rpm.

C: The range is 200 rpm or more.

(9) Maximum Storage Modulus E' Between −30° C. to 0° C.

Sheets with a thickness of 0.5 mm were produced from the resin component constituting the intermediate. Test pieces having a length of 30 mm, a width of 4 mm, and a thickness of 0.5 mm in a plate-like form were cut out from these sheets. The both ends of test pieces were clamped with chucks so that the length of displacement becomes 20 mm. The storage modulus was measured under the following conditions using Viscoelasticity spectrometer Rheogel-E4000 available from UBM CO., Ltd to determine the Maximum storage modulus E' between −30° C. to 0° C.

Initial load: Auto static load 200%

Amplitude: 0.025%

Frequency: 10 Hz

Initial temperature: −100° C.

End temperature: 100° C.

Temperature increasing rate: 4° C./min

Measuring mode: tensile mode

[Production of Golf Balls]

(1) Production of Center

Centers were obtained by kneading rubber compositions having the formulations shown in Table 1, and heat-pressing the kneaded material in upper and lower molds, each having a hemispherical cavity, at 170° C. for 30 minutes.

TABLE 1

| Center No. | | a | b | c |
|---|---|---|---|---|
| Formulation | Polybutadiene Rubber | 100 | 100 | 100 |
| | Zinc acrylate | 40 | 35 | 32 |
| | Zinc oxide | 10 | 5 | 5 |
| | Barium sulfate | Appropriate amount*) | Appropriate amount*) | Appropriate amount*) |
| | PBDS | — | 0.9 | 0.9 |
| | Diphenyl disulfide | 0.5 | — | — |
| | Dicumyl peroxide | 0.8 | 0.9 | 0.9 |
| Properties | Diameter (mm) | 39.8 | 39.8 | 39.8 |
| | Surface hardness Hs1 (Shore D hardness) | 60 | 61 | 62 |
| | Center hardness (Shore D hardness) | 43 | 55 | 56 |
| | Compression deformation amount (mm) | 2.70 | 2.80 | 2.95 |

Formulation: parts by mass

*)An amount was adjusted such that the golf ball had a mass of 45.4 g.

Polybutadiene rubber: "BR-730 (high-cis polybutadiene)" manufactured by JSR Corporation Zinc acrylate: "ZNDA-90S" manufactured by Nihon Jyoryu Kogyo Co., Ltd.

Zinc oxide: "Ginrei R" manufactured by Toho Zinc Co., Ltd.

Barium sulfate: "Barium Sulfate BD" manufactured by Sakai Chemical Industry Co., Ltd.

PBDS: Bis(pentabromophenyl) disulfide

Dicumyl peroxide: "Percumyl (registered trademark) D" manufactured by NOF Corporation (2) Preparation of Cover Composition and Intermediate Layer Composition Blending materials shown in Tables 2 to 4 were mixed with a twin-screw kneading extruder to prepare cover compositions in the pellet form and intermediate layer compositions in the pellet form, respectively. The extruding conditions were a screw diameter of 45 mm, a screw rotational speed of 200 rpm, and screw L/D=35, and the mixtures were heated to 160 to 230° C. at the die position of the extruder.

TABLE 2

| Cover composition No. | | a | b | c | d |
|---|---|---|---|---|---|
| Formulation | Elastollan XNY 85A | 100 | 50 | — | — |
| | Elastollan XNY 83A | — | 50 | 100 | — |
| | Elastollan XNY 75A | | | — | 100 |
| | Titanium oxide | 4 | 4 | 4 | 4 |
| Properties | Slab hardness (JIS-A hardness) | 85 | 84 | 83 | 75 |

Formulation: parts by mass

Elastollan XNY85A: a thermoplastic polyurethane elastomer manufactured by BASF Japan Ltd.

Elastollan XNY83A: a thermoplastic polyurethane elastomer manufactured by BASF Japan Ltd.

Elastollan XNY75A: a thermoplastic polyurethane elastomer manufactured by BASF Japan Ltd.

(3) Production of Golf Ball Body

A spherical core was produced by injection-molding the intermediate layer composition onto the center thus obtained to form an intermediate layer covering the center. Then, a golf ball was produced by injection-molding the cover composition onto the spherical core to form a cover. Upper and lower molds have a spherical cavity with pimples, a part of which serves as a hold pin which is extendable and retractable. The hold pins were protruded to hold the core, the resin heated at 210° C. was charged into the mold under a pressure of 80 tons within 0.3 seconds, and cooled for 30 seconds. Then, the mold was opened, and the golf ball body was taken out from the mold. The surface of the obtained golf ball body was treated with sandblast, marked, and painted with a clear paint. The paint was dried in an oven at 40° C., and golf balls with a diameter of 42.8 mm and a mass of 45.4 g were obtained.

The evaluation results of spin rate, compression deformation amount, and flight distance for the obtained golf ball are shown in Tables 3 and 4.

TABLE 3

| Golf ball No. | | | | 1 | 2 | 3 | 4 | 5 |
|---|---|---|---|---|---|---|---|---|
| Intermediate layer | Intermediate layer composition | Center No. | | a | a | b | b | b |
| | | Formulation | (A) NOVAMID ST120 | 5 | 15 | 30 | 40 | 50 |
| | | | (B) SURLYN 8945 | 47.5 | 42.5 | 35 | 30 | 25 |
| | | | HIMILAN AM7329 | 47.5 | 42.5 | 35 | 30 | 25 |
| | | | Zelas MC616 | — | — | — | — | — |
| | | | Titanium oxide | 4 | 4 | 4 | 4 | 4 |
| | | MFR(240° C., 2.16 kg) (g/10 min) | | 31 | 24 | 12 | 11 | 2.9 |
| | | Slab Hardness (Shore D) | | 65 | 65 | 65 | 66 | 67 |
| | | Slab Flexural modulus (MPa) | | 326 | 338 | 343 | 389 | 492 |
| | | Max. Storage modulus E' (MPa) *1) | | 1100 | 1200 | 1500 | 1700 | 1850 |
| | Thickness (mm) | | | 1.0 | 1.0 | 1.0 | 1.0 | 1.0 |
| Core | Diameter (mm) | | | 41.8 | 41.8 | 41.8 | 41.8 | 41.8 |
| Property | Center hardness Ho (Shore D) | | | 43 | 43 | 55 | 55 | 55 |
| | Surface hardness Hs (Shore D) | | | 65 | 65 | 65 | 66 | 67 |
| Cover | Cover composition No. | | | a | b | b | b | c |
| | Hardness (JIS-A) | | | 85 | 84 | 84 | 84 | 83 |
| | Thickness (mm) | | | 0.5 | 0.5 | 0.5 | 0.5 | 0.5 |
| | Compression deformation amount (mm) | | | 2.45 | 2.43 | 2.56 | 2.55 | 2.54 |
| | Durability (Index) | | | 102 | 102 | 102 | 100 | 82 |
| | Driver shot | | Ball speed (m/s) | 74.2 | 74.6 | 74.7 | 74.6 | 74.5 |
| | | | Launch angle (°) | 11.1 | 11.2 | 11.4 | 11.4 | 11.4 |
| | | | Spin rate (rpm) | 2460 | 2440 | 2430 | 2420 | 2420 |

TABLE 3-continued

| Golf ball No. | | | 1 | 2 | 3 | 4 | 5 |
|---|---|---|---|---|---|---|---|
| | | Flight distance (m) | 249 | 249 | 250 | 250 | 251 |
| | Approach wedge shot | Spin rate (rpm) | 6290 | 6260 | 6255 | 6255 | 6250 |
| | | Spin stability | A | A | A | A | A |

TABLE 4

| Golf ball No. | | | | 6 | 7 | 8 |
|---|---|---|---|---|---|---|
| | | Center No. | | a | c | b |
| Intermediate layer | Intermediate layer composition | Formulation | (A) NOVAMID ST120 | 0 | 70 | — |
| | | | (B) SURLYN 8945 | 50 | 15 | — |
| | | | HIMILAN AM7329 | 50 | 15 | — |
| | | | Zelas MC616 | — | — | 100 |
| | | | Titanium oxide | 4 | 4 | 4 |
| | | MFR(240° C., 2.16 kg) (g/10 min) | | *2) | 7 | 27 |
| | | Slab Hardness (Shore D) | | 64 | 70 | 64 |
| | | Slab Flexural modulus (MPa) | | 312 | 712 | 500 |
| | | Max. Storage modulus E' (MPa) *1) | | 980 | 2200 | 3600 |
| | Thickness (mm) | | | 1.0 | 1.0 | 1.0 |
| Core | Diameter (mm) | | | 41.8 | 41.8 | 41.8 |
| Property | Center hardness Ho (Shore D) | | | 43 | 56 | 55 |
| | Surface hardness Hs (Shore D) | | | 65 | 72 | 65 |
| Cover | Cover composition No. | | | a | d | d |
| | Hardness (JIS-A) | | | 85 | 75 | 75 |
| | Thickness (mm) | | | 0.5 | 0.5 | 0.5 |
| | Compression deformation amount (mm) | | | 2.45 | 2.55 | 2.55 |
| | Durability (Index) | | | 102 | 82 | 30 |
| | Driver shot | | Ball speed (m/s) | 74.5 | 74.3 | 73.8 |
| | | | Launch angle (°) | 11.0 | 11.1 | 11.5 |
| | | | Spin rate (rpm) | 2520 | 2550 | 2300 |
| | | | Flight distance (m) | 248 | 248 | 246 |
| | Approach wedge shot | | Spin rate (rpm) | 6300 | 6350 | 6200 |
| | | | Spin stability | A | A | C |

Notes on tables 3, 4

Formulation: parts by mass

*1) Max. Storage modulus E': Maximum of Storage modulus between −30° C. to 0° C.

*2) Impossible to measure (too much flow)

SURLYN 8945: a sodium ion neutralized ethylene-methacrylic acid copolymer ionomer resin (flexural modulus: 254 MPa) available from E. I. du Pont de Nemours and Company.
HIMILAN AM7329: a zinc ion neutralized ethylene-methacrylic acid copolymer ionomer resin (flexural modulus: 240 MPa) available from Du Pont-Mitsui Polychemicals Co., Ltd.
NOVAMID ST120: a mixed resin of polyamide 6 and a resin having at least one functional group selected from the group consisting of a hydroxyl group, a carboxyl group, an anhydride group, a sulfonic acid group, and an epoxy group (including a glycidyl group), (flexural modulus: 2,000 MPa, melt flow rate (240° C., 2.16 kg): 30 g/10 min) available from Mitsubishi Engineering-Plastics Company.
Zelas MC616: Olefin elastomer available from Mitsubishi Chemical Corporation.

Each of Golf balls No. 1 to 5 is the case that the golf ball has a core consisting of a center and at least one intermediate layer covering the center, and a cover covering the core, wherein the cover contains polyurethane, and has a slab hardness of 85 or less in JIS A hardness, the core has a surface hardness of 60 or more in Shore D hardness, the intermediate layer has a thickness ranging from 0.5 mm to 2.0 mm, and a resin component constituting the intermediate layer has a hardness from 62 to 68 in Shore D hardness, a flexural modulus from 300 MPa to 500 MPa, and a maximum storage modulus E' between −30° C. to 0° C. ranging from 1,000 MPa to 2,000 MPa. If comparing golf balls Nos. 1 to 5 with golf ball No. 6, it is clear that the decrease in the spin rate on approach shots was suppressed, although the spin rate on driver shots was lowered. Golf ball No. 6 is a conventional golf ball employing an intermediate layer consisting of an ionomer resin. Golf ball No. 7 is the case that the resin component constituting the intermediate layer has high hardness, rigidity and storage modulus. The spin rates were increased on both driver shots and approach shots. Professional golfers or high skilled golfers tend to have the feeling that the spin rate was lowered, if the amount of decrease in the spin rate was more than 50 rpm on driver shots and approach shots. According to the present invention, it is possible to reduce the spin rate on driver shots by 50 rpm or more, while suppressing the decrease in the spin rate on approach shots within 50 rpm.

The present invention is suitable to golf balls having a urethane cover. This application is based on Japanese Patent application No. 2010-073290 filed on Mar. 26, 2010, the contents of which are hereby incorporated by reference.

The invention claimed is:

1. A golf ball having:

a core consisting of a center and at least one intermediate layer covering the center, and a cover covering the core, wherein the cover contains polyurethane, and has a slab hardness of 85 or less in JIS A hardness, the core has a surface hardness of 60 or more in Shore D hardness, the intermediate layer has a thickness ranging from 0.5 mm to 1.5 mm, and a resin component constituting the intermediate layer has a hardness from 62 to 68 in Shore D hardness, a flexural modulus from 300 MPa to 500 MPa, and a maximum storage modulus E' between −30° C. to 0° C. ranging from 1,000 MPa to 2,000 MPa, wherein the intermediate layer is formed from a high fluidity intermediate layer composition that contains as a resin component consisting of:

(A) a polyamide resin composition having a flexural modulus in a range from 500 MPa to 4,000 MPa and a melt flow rate (240° C., 2.16 kg) of 5.0 g/10 min or more, and containing (a-1) a polyamide resin and (a-2) a resin having at least one functional group selected from the group consisting of a hydroxyl group, a carboxyl group, an anhydride group, a sulfonic acid group, and an epoxy group; and (B) at least one member selected from the group consisting of an ethylene-(meth)acrylic acid binary copolymer, a metal-neutralized product of the ethylene-(meth)acrylic acid binary copolymer, an ethylene-(meth)acrylic acid-(meth)acrylic acid ester ternary copolymer, and a metal-neutralized product of the ethylene-(meth)acrylic acid-(meth)acrylic acid ester ternary copolymer, wherein (a-1) the polyamide resin is at least one selected from the group consisting of polyamide 6, polyamide 11, polyamide 12, polyamide 66, polyamide 610, polyamide 6T, polyamide 6I, polyamide 9T, polyamide M5T, polyamide 612, and a polyether block amide copolymer, and wherein the resin component has a melt flow rate (240° C., 2.16 kg) ranging from 1.0 g/10 min to 30.0 g/10 min.

2. The golf ball according to claim 1, wherein a blending ratio (A/B, total:100 mass %) of (A) component to (B) component in the high fluidity intermediate layer composition is from 5 mass %/95 mass % to 50 mass %/50 mass %.

3. The golf ball according to claim 1, wherein (a-2) the resin having at least one functional group selected from the group consisting of a hydroxyl group, a carboxyl group, an anhydride group, a sulfonic acid group, and an epoxy group is a thermoplastic elastomer.

4. The golf ball according to claim 3, wherein the thermoplastic elastomer contains at least one member selected from the group consisting of a thermoplastic polyolefin elastomer, a thermoplastic polyester elastomer, a thermoplastic polyamide elastomer, a thermoplastic polyurethane elastomer, and a thermoplastic styrene elastomer.

5. The golf ball according to claim 3, wherein the thermoplastic elastomer is a thermoplastic styrene elastomer.

6. The golf ball according to claim 1, wherein (B) component is the metal-neutralized product of the ethylene-(meth) acrylic acid binary copolymer, and/or the metal-neutralized product of the ethylene-(meth)acrylic acid-(meth)acrylic acid ester ternary copolymer, and is neutralized with at least one metal selected from the group consisting of Li, Na, Ca, Zn, Mg and Cu.

7. The golf ball according to claim 6, wherein a degree of neutralization of acidic groups contained in the metal-neutralized product of the ethylene-(meth)acrylic acid binary copolymer and/or the ethylene-(meth)acrylic acid-(meth) acrylic acid ester ternary copolymer is from 20 mole % to 90 mole %.

8. The golf ball according to claim 1, wherein (B) component has a flexural modulus ranging from 150 MPa to 1,000 MPa.

9. The golf ball according to claim 1, wherein the center has a compression deformation amount from 1.5 mm to 5.0 mm, when applying an initial load of 98 N to a final load of 1275 N to the center.

10. The golf ball according to claim 1, wherein the center has a surface hardness ranging from 40 to 75 in Shore D hardness.

11. The golf ball according to claim 1, wherein the core has a diameter ranging from 30 mm to 42.2 mm.

12. The golf ball according to claim 1, wherein the core has a compression deformation amount from 1.5 mm to 5.0 mm, when applying an initial load of 98 N to a final load of 1275 N to the core.

13. The golf ball according to claim 1, wherein the core has a center hardness Ho ranging from 20 to 60 in Shore D hardness.

14. The golf ball according to claim 1, wherein the core has a hardness difference ranging from 10 to 55 between a surface hardness and a center hardness thereof in Shore D hardness.

15. The golf ball according to claim 1, wherein the cover has a thickness ranging from 0.1 mm to 3 mm.

16. The golf ball according to claim 1, wherein the golf ball has a compression deformation amount from 2.0 mm to 3.0 mm, when applying an initial load of 98 N to a final load of 1275 N to the golf ball.

17. The golf ball according to claim 1, wherein a blending ratio (A/B, total:100 mass %) of (A) component to (B) component in the high fluidity intermediate layer composition is from 5 mass %/95 mass % to 15 mass %/85 mass %.

* * * * *